US010870197B2

(12) United States Patent
Maresca

(10) Patent No.: US 10,870,197 B2
(45) Date of Patent: Dec. 22, 2020

(54) SAWHORSE DEVICE

(71) Applicant: Fred Maresca, Nashville, TN (US)

(72) Inventor: Fred Maresca, Nashville, TN (US)

( * ) Notice: Subject to any disclaimer, the term of this patent is extended or adjusted under 35 U.S.C. 154(b) by 140 days.

(21) Appl. No.: 16/057,392

(22) Filed: Aug. 7, 2018

(65) Prior Publication Data

US 2019/0047136 A1 Feb. 14, 2019

Related U.S. Application Data

(60) Provisional application No. 62/542,948, filed on Aug. 9, 2017.

(51) Int. Cl.
*B25H 1/06* (2006.01)

(52) U.S. Cl.
CPC ..... *B25H 1/06* (2013.01)

(58) Field of Classification Search
CPC ..... B23Q 1/03; B23Q 1/25; B25H 1/06
USPC ..... 269/16, 134, 136, 138, 291, 309; 182/153
See application file for complete search history.

(56) References Cited

U.S. PATENT DOCUMENTS 2,889,178 A * 6/1959 Rambow ..... B25H 1/06 182/181.1
4,508,194 A * 4/1985 Freewalt ..... F16M 11/245 182/153
6,283,250 B1 * 9/2001 Asher ..... B25H 1/06 182/153

* cited by examiner

*Primary Examiner* — Lee D Wilson
*Assistant Examiner* — Alberto Saenz
(74) *Attorney, Agent, or Firm* — Patentfile, LLC; Bradley C. Fach; Steven R. Kick

(57) ABSTRACT

A saw horse device is provided. The device may include at least one block, such as a first block, rotatably coupled to a horizontal beam. The first block may have a first right surface and a first left surface. A first right leg may be coupled to the first right surface, and a first left leg may be coupled to the first left surface. The first block may be configured to be rotated between a parallel position and a perpendicular position. Optionally, one or more blocks may comprise a right block arrestor that rotationally arrests the first right leg to the block and/or a left block arrestor that rotationally arrests the left leg to the block.

19 Claims, 8 Drawing Sheets

SAWHORSE DEVICE

CROSS REFERENCE TO RELATED APPLICATIONS

This application claims priority to and the benefit of the filing date of U.S. Provisional Application No. 62/542,948, filed on Aug. 9, 2017, entitled "SAWHORSE DEVICE", which is hereby incorporated by reference in its entirety.

FIELD OF THE INVENTION

This patent specification relates to the field of sawhorses, portable trestles, scaffolds and the like. More specifically, this patent specification relates to a portable and collapsible sawhorse device.

BACKGROUND

The well-known sawhorse typically comprises a horizontal beam, supported by at least two pairs of legs, a pair at each end of the beam, which are affixed to the horizontal beam so as to extend downwardly and outwardly at a divergent angle.

Currently available sawhorse designs, such as the EZ Buck, described in U.S. Pat. No. 4,508,914, have a lower bracket that allows rotation of the legs to a flat configuration with the beam; however, a probable deficiency with designs like this is they do not provide a robust clamping action on the outer surface of the legs against a rigid, solid component, and a means of maintaining optimum tightness of the connection in order to maintain firm contact of the legs to the component which connects to the beam, and to have great resistance to lateral and torsional deflection of the legs relative to the block.

Therefore, a need exists for novel sawhorse devices. A further need exists for novel sawhorse devices having a robust means of clamping readily detachable legs. There is also a need for novel sawhorse devices which offer increased stability and which will have great resistance to lateral and torsional deflection of the legs.

BRIEF SUMMARY OF THE INVENTION

A saw horse device is provided. In some embodiments, the device may include at least one block, a first block, rotatably coupled to a horizontal beam. The first block may have a first right surface and a first left surface. A first right leg may be coupled to the first right surface, and a first left leg may be coupled to the first left surface. The first block may be configured to be rotated between a parallel position and a perpendicular position.

In further embodiments, a sawhorse device may include a first block rotatably coupled to a horizontal beam and a second block rotatably coupled to the horizontal beam. The first block and second block may each be configured to be rotated between a parallel position and a perpendicular position. The first block may have a first bearing surface that is substantially planar in shape, a first right surface, and a first left surface, and the first right surface and first left surface may be angled relative to each other by approximately between 19 and 25 degrees. A first right leg may be coupled to the first right surface, and a first left leg coupled to the first left surface. The second block may have a second bearing surface, a second right surface and a second left surface, and the second right surface and second left surface may be angled relative to each other by approximately between 19 and 25 degrees. A second right leg may be coupled to the second right surface, and a second left leg may be coupled to the second left surface.

In still further embodiments, one or more blocks may comprise a right block arrestor that rotationally arrests the first right leg to the block and/or a left block arrestor that rotationally arrests the left leg to the block.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
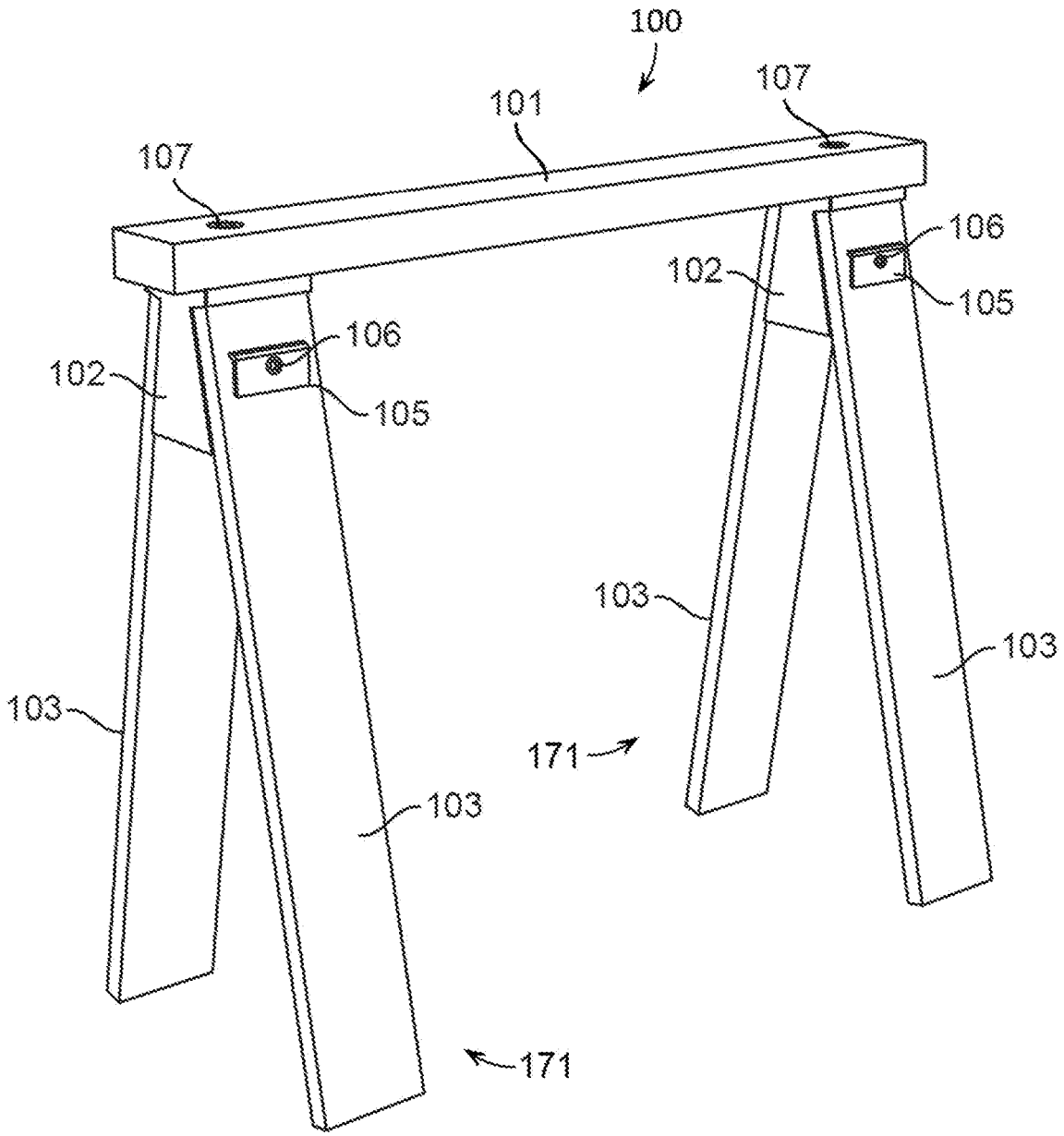
FIG. 1 depicts a perspective view of an example of a sawhorse device having its legs in a perpendicular position according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new sawhorse device is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

Figure 2:
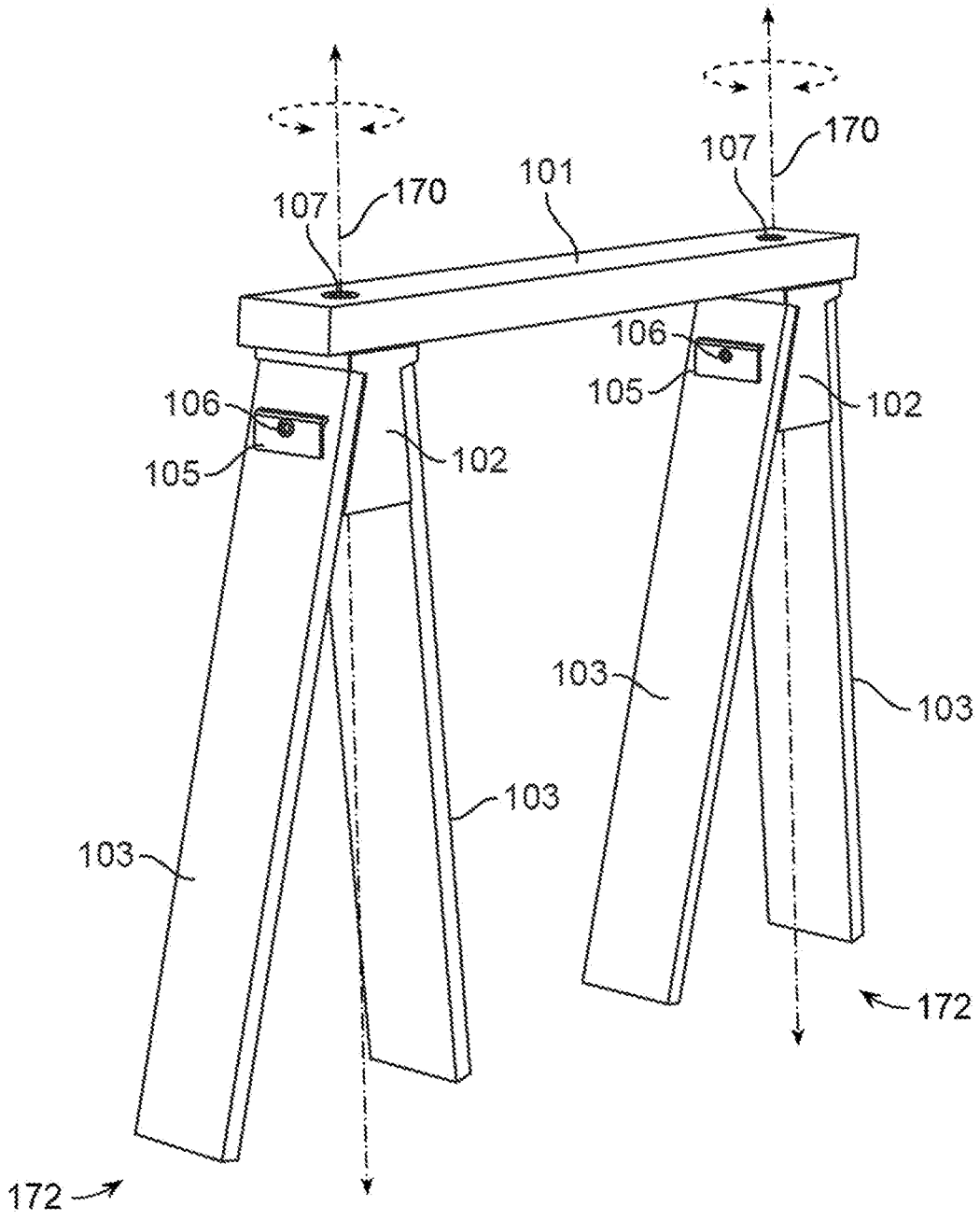
FIG. 2 illustrates a perspective view of an example of a sawhorse device having its legs in a parallel position according to various embodiments described herein.
Figure 3:
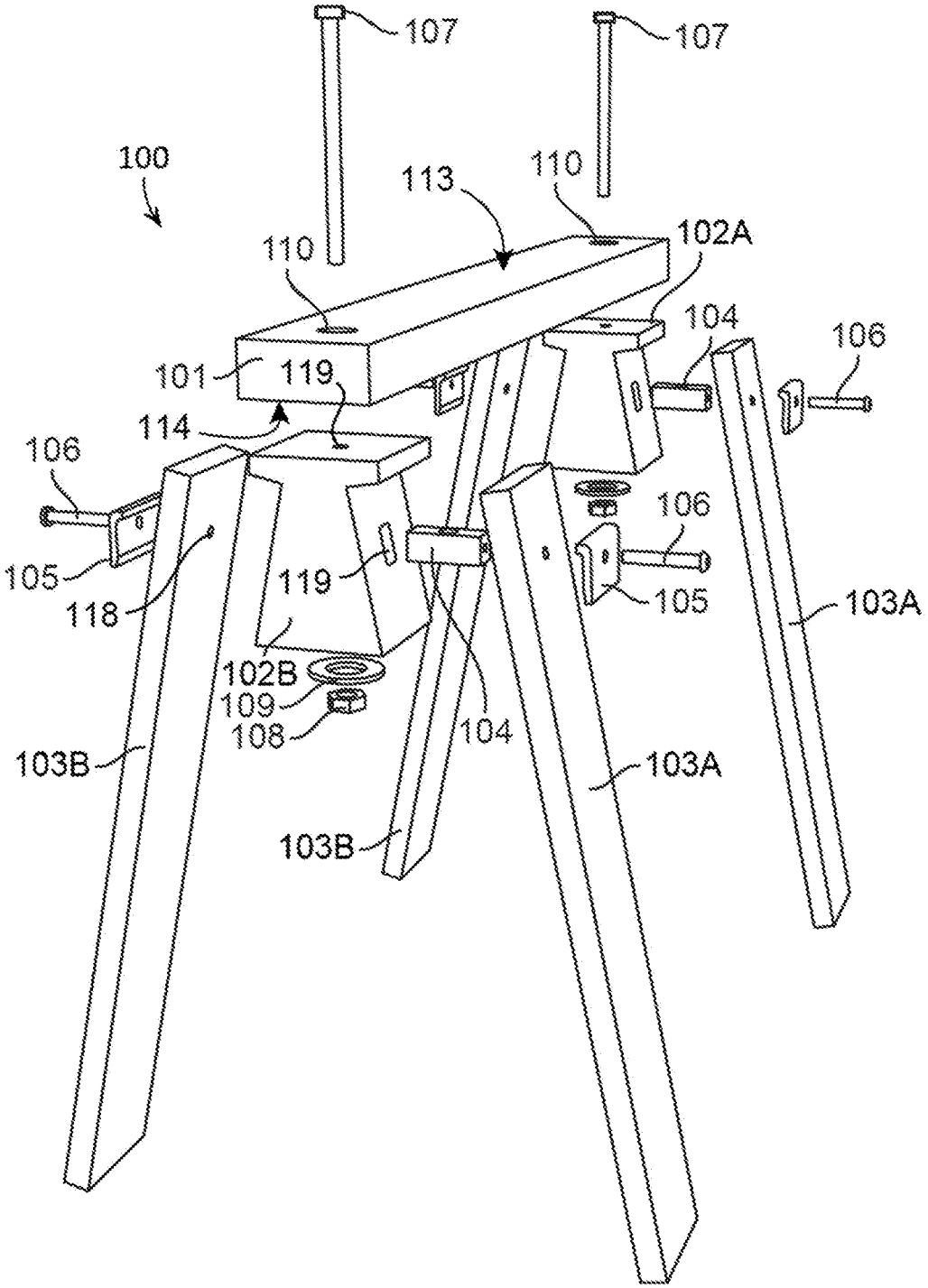
FIG. 3 shows a perspective exploded view of an example of a sawhorse device according to various embodiments described herein.

The present invention will now be described by example and through referencing the appended figures representing preferred and alternative embodiments. FIGS. 1-3 illustrate examples of a sawhorse device ("the device") 100 according to various embodiments. In some embodiments, the device 100 may comprise a horizontal beam 101. One or more blocks 102 may be rotatably coupled to the beam 101, and each block 102 may comprise a right surface 13 and a left surface 112. One or more legs 103 may be coupled to each block 102. Optionally, a right leg 103A may be coupled to a right surface 13 of a block 102 and a left leg 103B may be coupled to the left surface 112 of the block 102. One or more, and preferably each, block 102 may be movable by being able to be rotated between a perpendicular position 171 (FIG. 1) and a parallel position 172 (FIG. 2).

The device 100 may comprise a horizontal beam 101 which may be suitable for supporting objects placed on the device 100. The horizontal beam 101 may comprise an upper surface 113 and an opposing lower surface 114. In some embodiments, an upper surface 113 and/or a lower surface 114 may be substantially planar or flat in shape. In other embodiments, an upper surface 113 and/or a lower surface 114 may comprise texturing, a curved shape, or any other shape. Optionally, a horizontal beam 101 may comprise one or more beam apertures 110 which may receive portions of a vertical fastener 107. Preferably, a beam aperture 110 may be shaped and sized to allow portions of the vertical fastener 107 to fit inside the beam aperture 110 so that the vertical fastener 107 does not extend above the upper surface 113 of the horizontal beam 101.

The device 100 may comprise one or more blocks 102, such as a right block 102A and a left block 102B, which may be coupled to or proximate to the lower surface 17. In preferred embodiments, one or more blocks 102 may be movably coupled to the horizontal beam 101 so that the block(s) 12 may be rotated around a vertical axis 170. In this manner, a block 102 may be rotatably coupled to the horizontal beam 101. In some embodiments, a block 102 may be rotatably coupled to the horizontal beam 101 via a vertical fastener 107. A vertical fastener 107 may allow the block 102 to rotate around a vertical axis 170 between a parallel position 172 and a perpendicular position 171. In preferred embodiments, when a block 102 is in the parallel position 172, the legs 103 coupled to the block 102 may be aligned lengthwise with the horizontal beam 101 as shown in FIG. 2. In further preferred embodiments, when a block 102 is in the perpendicular position 171, the legs 103 coupled to the block 102 may extend out widthwise from either side of the horizontal beam 101 as shown in FIG. 1. In some embodiments, a block 102 may be rotated approximately 90 degrees to transition between a parallel position 172 and a perpendicular position 171. In other embodiments, a block 102 may be rotated any number of degrees, such as between 0.01 degrees and 360 degrees to transition between a parallel position 172 and a perpendicular position 171.

In preferred embodiments, a vertical fastener 107 may comprise an elongated threaded fastener, such as a bolt or screw, which may be threadedly engaged to a block 102 and/or to one or more other fasteners, such as a nut 108 and washer 109. In other embodiments, a vertical fastener 107 may comprise any fastener or fastening method which may be used to rotatably couple a block 102 to a horizontal beam 101 so that the block 102 may be linked, connected, or fastened such that the block 102 can rotate, turn, or move around a fixed point. For example, a vertical fastener may include a rivet, bearing, ball or roller bearing joint, nut and bolt, knuckle joint, a turnbuckle, a pin joint, a pivot joint, a cotter joint, a bolted joint, a flexible material joint, a screw joint, a universal joint, a butt hinge, butterfly hinge, flush hinge, barrel hinge, concealed hinge, continuous hinge, T-hinge, strap hinge, double-acting hinge, Soss hinge, a flexible material hinge, a four-bar linkage, a scissor linkage, a collapsible pole linkage, or any other suitable mechanical or physical linkage which may be used to couple a first element or component to a second element or component while allowing the first element or component to move, pivot, or rotate relative to the second element or component. Optionally, a block 102 may be rotatably and removably coupled to a horizontal beam 101 via a vertical fastener 107. For example, a vertical fastener 107 may comprise a bayonet mount.

A block 102 may comprise any structure to which one or more legs 103 and horizontal beams 101 may be coupled. In some embodiments, a block 102 may comprise a bearing surface 115. In further embodiments, a bearing surface 115 may support portions of a horizontal beam 101, such as the lower surface 114, that may be coupled to the block 102. In preferred embodiments, a bearing surface 115 may be substantially planar or flat in shape. In other embodiments, a bearing surface 115 may comprise texturing, a curved shape, or any other shape. In still further embodiments, a vertical fastener 107 coupling a block 102 to a horizontal beam 101 may be coupled to the bearing surface 115 of the block 102 and/or to the lower surface 114 of the horizontal beam 101. Optionally, a block 102 may comprise one or more block apertures 119 which may be shaped to receive fasteners, such as vertical fasteners 107, leg fasteners 106, couplers 104, etc.

Figure 4:
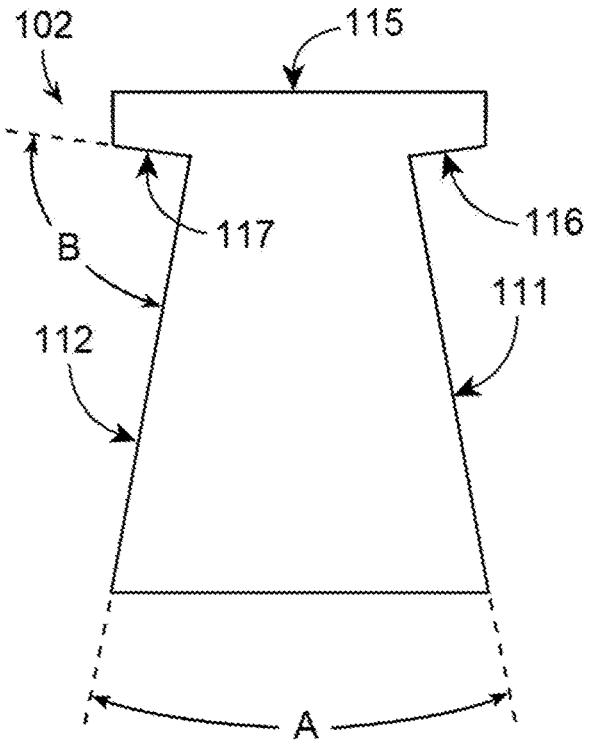
FIG. 4 depicts a front elevation view of an example of a block of a sawhorse device according to various embodiments described herein.
Figure 5:
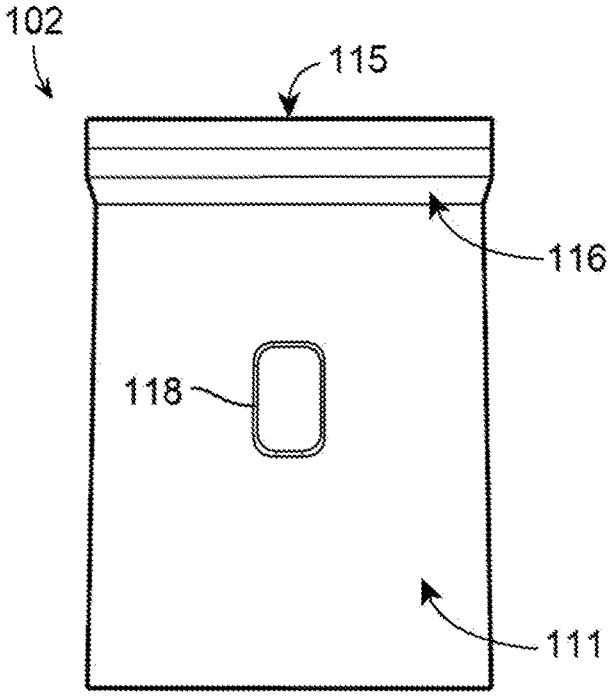
FIG. 5 illustrates a right side elevation view of an example of a block of a sawhorse device according to various embodiments described herein.

In some embodiments, a block may comprise a right surface 111 and a left surface 112 which may be positioned on opposite sides of the block 102. Generally, one or more legs 103 may be coupled to or proximate to a right surface 111 and/or a left surface 112. In preferred embodiments, a right surface 111 and/or a left surface 112 may be generally planar or flat in shape. In other embodiments, a right surface 111 and/or a left surface 112 may comprise texturing, a curved shape, or any other shape. In some embodiments, a right surface 111 may be angled approximately between 10 and 40 degrees relative to a left surface 112 as shown by angle A in FIG. 4. In preferred embodiments, a right surface 111 may be angled approximately between 19 and 25 degrees relative to a left surface 112. In further embodiments, a leg 103 may be coupled to a right surface 111 or a left surface 112, such by being integrally formed with or molded with the block 102, via one or more leg fasteners 106, adhesive, etc., so that the leg 103 extends away from the block 102 at an angle of approximately between 10 and 40 degrees relative to a leg 103 coupled to the opposing side of the block 102. In further preferred embodiments, a leg 103 may be coupled to a right surface 111 or a left surface 112, such by being integrally formed with or molded with the block 102, via one or more leg fasteners 106, adhesive, etc., so that the leg 103 extends away from the block 102 at an angle of approximately between 19 and 25 degrees relative to a leg 103 coupled to the opposing side of the block 102.

In some embodiments, a block 102 may comprise a right stop surface 116 for contacting portions of a leg 103, such as a right leg 103A, coupled to or proximate to a right surface 111, and/or a block 102 may comprise a left stop surface 117 for contacting portions of a leg 103, such as a left leg 103B, coupled to or proximate to a left surface 112. In some embodiments, a right stop surface 116 and/or a left stop surface 117 may be generally planar or flat in shape. In other embodiments, a right stop surface 116 and/or a left stop surface 117 may comprise texturing, a curved shape, or any other shape. In some embodiments, a stop surface 116, 117, may be angled approximately between 60 and 120 degrees relative to its respective surface 111, 112, as shown by angle B in FIG. 4. In preferred embodiments, a right stop surface 116 may be substantially perpendicular, such as between 80 and 100 degrees, to a right surface 111 and a left stop surface 117 may be approximately perpendicular, such as between 80 and 100 degrees, to left surface 112.

In some embodiments, the device 100 may comprise one or more legs 103 which may be movably coupled and/or removably coupled to a block 102. In preferred embodiments, the device 100 may comprise one or more legs 103 which may be coupled to a block 102 so that the leg(s) 12 may not be moved relative to the block 102. In some embodiments, one or more leg fasteners 106 may be configured to couple a leg 103 to a block 102. A leg fastener 106 may comprise any type of fastener, such as a screw, rivet, adhesive, heat bonding, etc. In preferred embodiments, a leg fastener 106 may comprise a threaded fastener, such as a bolt or screw, which may be inserted through a leg aperture 118 of a leg 103 and into a block 102 to removably couple the leg 103 to the block 102.

In further preferred embodiments, a block 102 may comprise a coupler 104 which may be inserted into a block aperture 119 formed into the block 102. Preferably, the coupler 104 may be configured as a type of turnbuckle, such as having female screw threads used to connect two rods, lengths of boat rigging, etc., lengthwise and to regulate their length or tension, which may be configured to threadedly accept or couple a vertical fastener 107, a first leg fastener 106, and/or a second leg fastener 106, thereby allowing the coupler 104 to secure a horizontal beam 101, a right leg 103A, and/or a left leg 103B via the engagement between the fasteners 107, 106, and the coupler 104. In some embodiments, a fastener, such as a screw, preferably vertically oriented with a nut, may protrude into the block aperture 119 that may be configured to tighten against the underside of the coupler 104, so that after the brackets 105 are tightened against a leg 103, tightening the fastener pushes the coupler 104 and the attached leg fasteners 106, along with the leg 103, towards the upper corner of the block 102 making the entire assembly more rigid.

In further preferred embodiments, a leg fastener 106 may be inserted through a bracket 105 which may be angled to form a perpendicular surface for contacting portions of a leg fastener 106, such as the head of the leg fastener 106. The bracket 105 may be made of metal or other durable material and used to spread the compressive force of a leg fastener 106 over a wider area of the leg 103 and/or used to prevent the leg fastener 106 from damaging the leg 103. In still further embodiments, a leg 103 may be coupled to a block 102 via two or more brackets 105 and/or leg fasteners 106. For example, for a more rigid version, the device 100 may comprise more than one bracket 105 per leg 103, such as a pair of brackets 105 on each leg 103, one over the other, and two or more leg fasteners 106 per bracket, preferably with two or more corresponding couplers 104, or any variation thereof. Additionally, a bracket 105 may be configured in any size and shape. For example, the device 100 may comprise a bracket 105 having a width approximately as wide as a leg 103, with two or more leg fasteners 106, such as on opposing sides of the bracket 105 (preferably with corresponding couplers 104), rather than one leg fastener 106 in the middle of the bracket 105.

A horizontal beam 101 and/or leg 103 may comprise any shape, and preferably an elongated shape, having a length substantially greater than its width and height. In some embodiments, a horizontal beam 101 and/or leg 103 may comprise a generally elongated rectangular prism shape. In further embodiments, a horizontal beam 101 and/or leg 103 may comprise an elongated cylindrical shape. In other embodiments, a horizontal beam 101 and/or leg 103 may comprise an elongated hexagonal prism shape. In alternative embodiments, a horizontal beam 101 and/or leg 103 may comprise an elongated triangular prism shape, an elongated rectangular prism shape, an elongated oval shape, or any other shape including combinations of shapes.

In some embodiments, a horizontal beam 101 and/or leg 103 may comprise a fixed length. In other embodiments, a horizontal beam 101 and/or leg 103 may comprise an adjustable length so that the horizontal beam 101 and/or leg 103 may be moved into and between a relatively longer length and a relatively short length. For example, a horizontal beam 101 and/or leg 103 may comprise two or more sections or segments which may be extended out of or retracted into each other thereby allowing the horizontal beam 101 and/or leg 103 to be adjustable in length.

In some embodiments, the right 111 and/or left 112 surfaces of a block 102 may comprise one or more block arrestors 120 and/or a leg 103 may comprise one or more leg arrestors 121. A block arrestor 120 may comprise a depression and/or protrusion which may contact or engage with portions of a leg 103, such as a leg arrestor 121, to rotationally arrest the leg 103 and block 102 together so that the leg 103 and block 102 may resist being rotated or otherwise moved relative to each other. Similarly, a leg arrestor 121 may comprise a depression and/or protrusion which may contact or engage with portions of a block 102, such as a block arrestor 120, to rotationally arrest the leg 103 and block 102 together so that the leg 103 and block 102 may resist being rotated or otherwise moved relative to each other. For example, a block arrestor 120 and/or a leg arrestor 121 may comprise fastener such as a detent pin or ball that locks a leg 103 and block 102 in an in-use position (for supporting the device 100 above a surface) and/or in a folded flat position (so that the legs 103 may be folded proximate to the horizontal beam 101 for storage), installed and manipulated from optionally the bottom of the block 102, such as through a long hole to the top of the block 102 or from the top of the beam 101. In some embodiments, a block arrestor 120 may be depressed into a block 102 while in other embodiments, a block arrestor 120 may protrude away from a block 102. Likewise, in some embodiments, a leg arrestor 121 may be depressed into a leg 103 while in other embodiments, a leg arrestor 121 may protrude away from a leg 103. In further embodiments, a block arrestor 120 may be depressed into or below a right 111 or left 112 surface of a block 102 while in other embodiments, a block arrestor 120 may protrude away or above from a right 111 or left 112 surface of a block 102.

Leg arrestors 121 and block arrestors 120 may be configured in any shape and size. In preferred embodiments, block arrestors 120 and leg arrestors 121 may be configured with complementary shapes so that a block arrestor 120 and leg arrestor 121 may be mated together as perhaps best shown in FIGS. 6-13.

Figure 6:
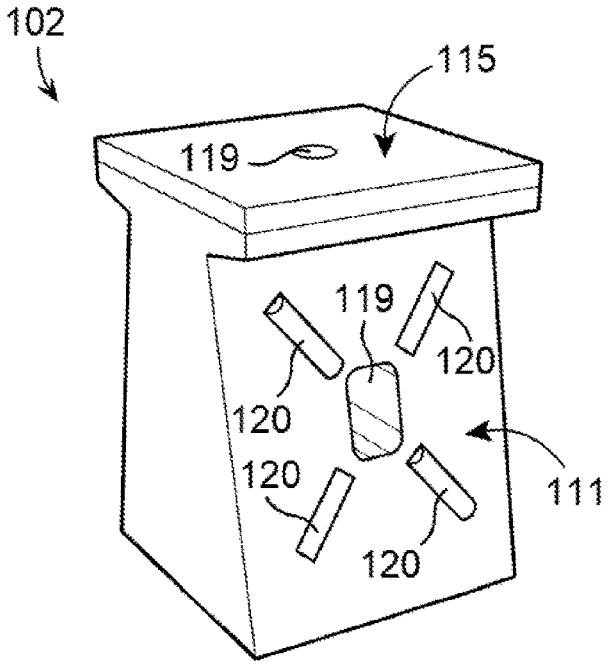
FIG. 6 shows a right perspective view of a further example of a block of a sawhorse device according to various embodiments described herein.
Figure 7:
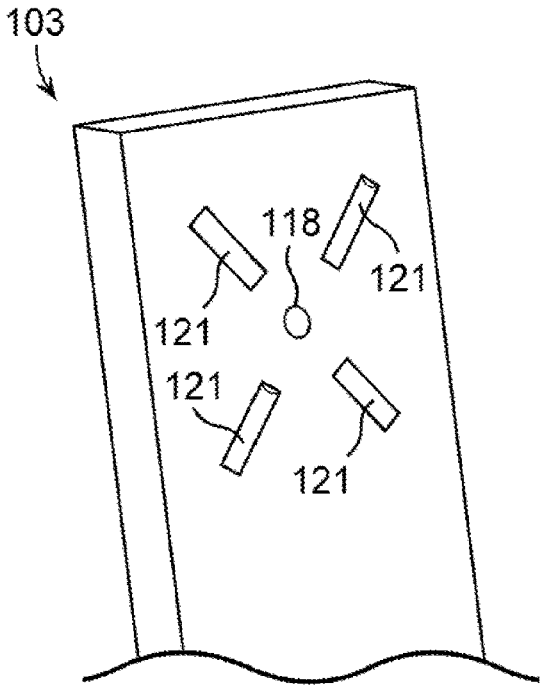
FIG. 7 depicts a partial perspective view of a further example of a leg of a sawhorse device which may be engaged to the example block of FIG. 6 according to various embodiments described herein.

In the examples of FIGS. 6 and 7, a block 102 may comprise four block arrestors 120 having a partial cylindrical shape that protrudes away from the block 102 and a leg 103 may comprise four leg arrestors 121 having a partial cylindrical shape that is depressed into the leg 103. The block arrestors 120 and leg arrestors 121 may be complementary in shape and have a radial orientation so that when the leg 103 and block 102 are coupled together, the block arrestors 120 may mate or fit into the leg arrestors 121 to rotationally arrest the leg 103 and block 102 together.

Figure 8:
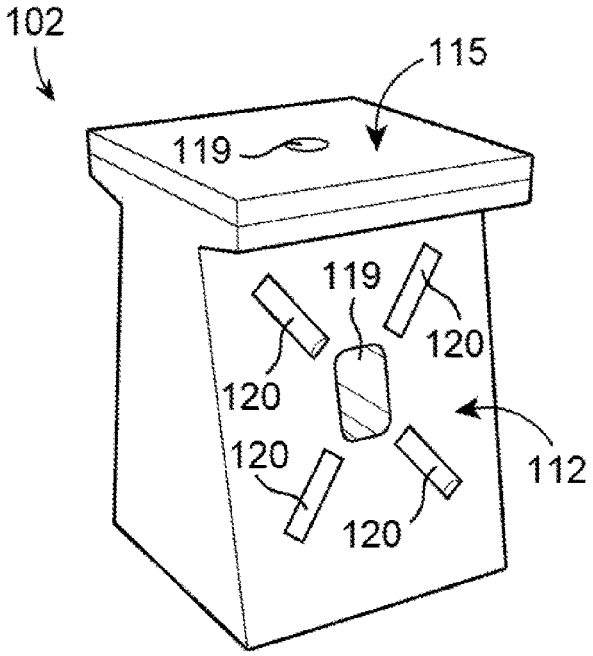
FIG. 8 illustrates a left perspective view of another example of a block of a sawhorse device according to various embodiments described herein.
Figure 9:
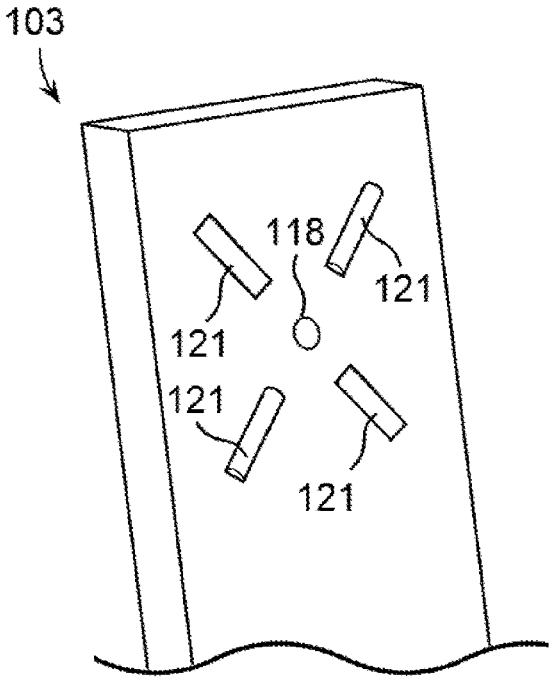
FIG. 9 shows a partial perspective view of another example of a leg of a sawhorse device which may be engaged to the example block of FIG. 8 according to various embodiments described herein.

In the examples of FIGS. 8 and 9, a block 102 may comprise four block arrestors 120 having a partial cylindrical shape that is depressed into the block 102 and a leg 103 may comprise four leg arrestors 121 having a partial cylindrical shape that protrudes away from the leg 103. The block arrestors 120 and leg arrestors 121 may be complementary in shape and have a radial orientation so that when the leg 103 and block 102 are coupled together, the leg arrestors 121 may mate or fit into the block arrestors 120 to rotationally arrest the leg 103 and block 102 together.

Figure 10:
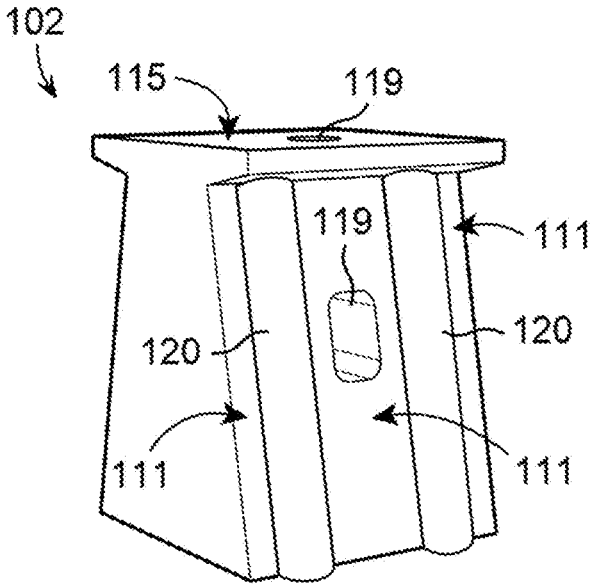
FIG. 10 depicts a right perspective view of still another example of a block of a sawhorse device according to various embodiments described herein.
Figure 11:
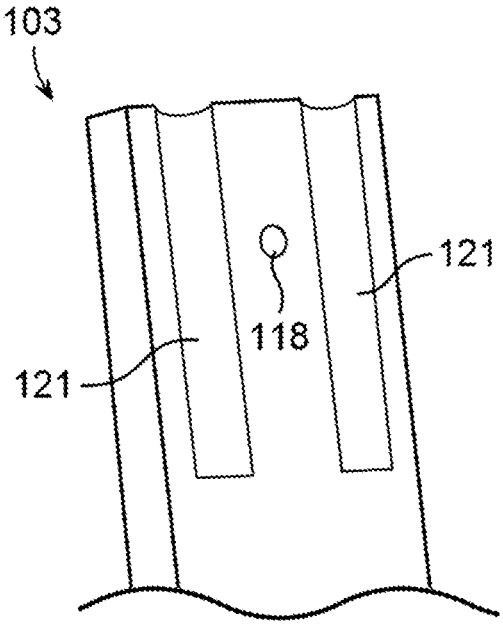
FIG. 11 illustrates a partial perspective view of still another example of a leg of a sawhorse device which may be engaged to the example block of FIG. 10 according to various embodiments described herein.

In the examples of FIGS. 10 and 11, a block 102 may comprise two block arrestors 120 having a partial cylindrical shape that protrudes away from the block 102 and a leg 103 may comprise two leg arrestors 121 having a partial cylindrical shape that is depressed into the leg 103. The block arrestors 120 and leg arrestors 121 may be complementary in shape and have a parallel orientation so that when the leg 103 and block 102 are coupled together, the block arrestors 120 may mate or fit into the leg arrestors 121 to rotationally arrest the leg 103 and block 102 together.

Figure 12:
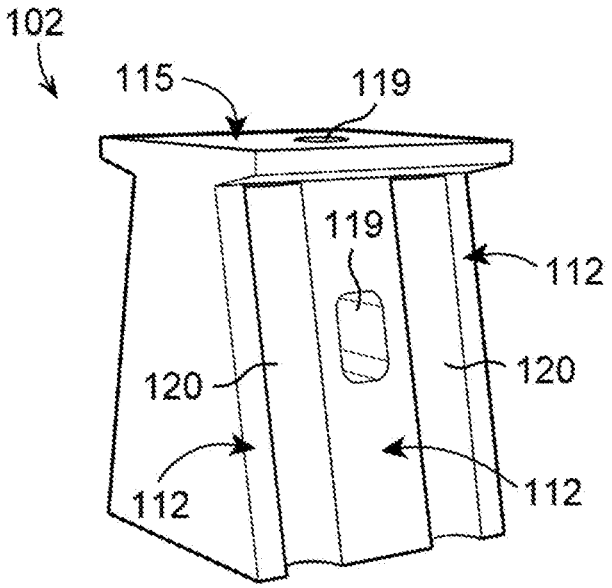
FIG. 12 shows a left perspective view of yet another example of a block of a sawhorse device according to various embodiments described herein.
Figure 13:
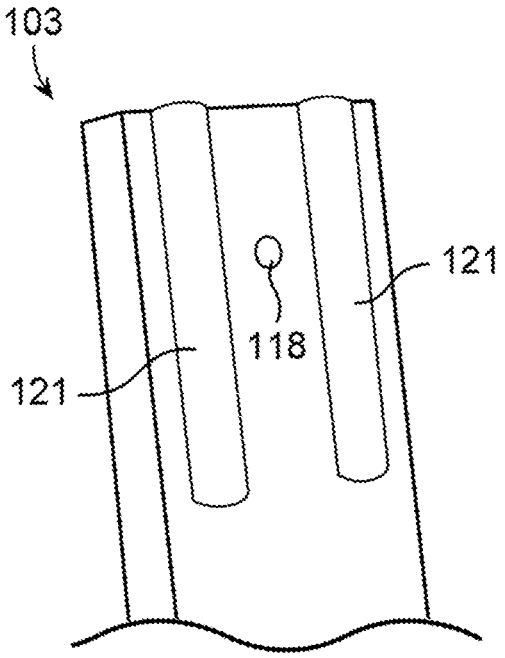
FIG. 13 depicts a partial perspective view of yet another example of a leg of a sawhorse device which may be engaged to the example block of FIG. 12 according to various embodiments described herein.

In the examples of FIGS. 12 and 13, a block 102 may comprise two block arrestors 120 having a partial cylindrical shape that is depressed into the block 102 and a leg 103 may comprise two leg arrestors 121 having a partial cylindrical shape that protrudes away from the leg 103. The block arrestors 120 and leg arrestors 121 may be complementary in shape and have a parallel orientation so that when the leg 103 and block 102 are coupled together, the leg arrestors 121 may mate or fit into the block arrestors 120 to rotationally arrest the leg 103 and block 102 together.

It should be understood that the device 100 may comprise one or more block arrestors 120 and/or leg arrestors 121 and that block arrestors 120 and leg arrestors 121 may be configured in any shape and size to enable portions of a leg 103 or block 102, respectively, to be received in a block arrestor 120 and leg arrestor 121. Referring to FIG. 12, a block 102 may comprise two block arrestors 120 having a partial cylindrical shape that is depressed into the block 102, and the device 100 may comprise two cylindrical legs 103 which may each be positioned in a block arrestor 120 and a leg fastener 106 may comprise a clamp which may clamp or otherwise secure the legs 103 to the block 102 with a portion of each leg 103 received in a cylindrical depression of a block arrestor 120.

While some exemplary shapes and sizes have been provided for elements of the device 100, it should be understood to one of ordinary skill in the art that the horizontal beam 101, blocks 102, legs 103, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the device 100 may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A sawhorse device, the device comprising:

a horizontal beam having a lower surface;

a first block rotatably coupled to the horizontal beam, the first block comprising:

(a) a first right surface facing externally away from the first block, (b) a first left surface facing externally away from the first block in an opposite direction from the first right surface, (c) a first right stop surface and a first left stop surface wherein the first right stop surface protrudes outwardly away from and overhangs the first right surface and wherein the first left stop surface protrudes outwardly away from and overhangs the first left surface;

(d) a bearing surface forming an upper end of the first block, the bearing surface in direct physical contact with the lower surface of the horizontal beam and configured to provide support to the horizontal beam;

a first right leg having a right leg upper terminal end and a right leg lower terminal end, the first right leg coupled to the first right surface outside of the first block and in contact with both the first right stop surface and the first right surface so that the right leg upper terminal end is in direct physical contact with the first right stop surface, and a first left leg having a left leg upper terminal end and a left leg lower terminal end, the first left leg coupled to the first left surface outside of the first block and in contact with both the first left stop surface and the first left surface so that the left leg upper terminal end is in direct physical contact with the first leg stop surface.

2. The device of claim 1, wherein the first right surface and first left surface are generally planar.

3. The device of claim 1, wherein the first block comprises a first right block arrestor that rotationally arrests the first right leg to the first block and a first left block arrestor that rotationally arrests the first left leg to the first block.

4. The device of claim 3, wherein a block arrestor selected from the group of the first right block arrestor and the first left block arrestor is depressed into the first block.

5. The device of claim 3, wherein a block arrestor selected from the group of the first right block arrestor and the first left block arrestor protrudes away from the first block.

6. The device of claim 1, wherein the first right stop surface is substantially perpendicular to the first right surface and the first left stop surface is approximately perpendicular to the first left surface.

7. The device of claim 1, wherein the first right surface and first left surface are angled relative to each other by approximately between 19 and 25 degrees.

8. The device of claim 1, wherein the first block is rotatably coupled to the horizontal beam via a vertical fastener.

9. The device of claim 8, wherein the vertical fastener allows the first block to rotate around a vertical axis between a parallel position and a perpendicular position.

10. The device of claim 1, wherein the first block comprises a first bearing surface that is substantially planar in shape.

11. A sawhorse device, the device comprising:

a horizontal beam;

a first block rotatably coupled to the horizontal beam, the first block having a first bearing surface that is substantially planar in shape, a first right surface, and a first left surface, wherein the first right surface and first left surface are angled relative to each other and wherein the first right surface and the first left surface each comprise a first block aperture;

a first right leg coupled to the first right surface, and a first left leg coupled to the first left surface;

a second block rotatably coupled to the horizontal beam, the second block having a second bearing surface, a second right surface and a second left surface, wherein the second right surface and second left surface are angled relative to each other and wherein the second right surface and the second left surface each comprise a second block aperture;

a second right leg coupled to the second right surface, and a second left leg coupled to the second left surface;

a first coupler configured to fit within the first block aperture, the first coupler having a first top opening to accept a first vertical fastener and side openings to accept a first leg fastener and a second leg fastener thereby allowing the first coupler to secure the horizontal beam, the first right leg, and the first left leg at the same time; and a second coupler configured to fit within the second block aperture, the second coupler having a second top opening to accept a second vertical fastener and side openings to accept a third leg fastener and a fourth leg fastener thereby allowing the second coupler to secure the horizontal beam, the second right leg, and the second left leg at the same time.

12. The device of claim 11, wherein the first right surface, first left surface, second right surface, and second left surface are generally planar.

13. The device of claim 11, wherein the first block comprises a first right block arrestor that rotationally arrests the first right leg to the first block and a first left block arrestor that rotationally arrests the first left leg to the first block, and wherein the second block comprises a second right block arrestor that rotationally arrests the second right leg to the second block and a second left block arrestor that rotationally arrests the second left leg to the second block.

14. The device of claim 13, wherein a block arrestor selected from the group of the first right block arrestor and the first left block arrestor is depressed into the first block, and wherein a block arrestor selected from the group of the second right block arrestor and the second left block arrestor is depressed into the second block.

15. The device of claim 13, wherein a block arrestor selected from the group of the first right block arrestor and the first left block arrestor protrudes away from the first block, and wherein a block arrestor selected from the group of the second right block arrestor and the second left block arrestor protrudes away from the second block.

16. The device of claim 11, wherein the first block comprises a first right stop surface for contacting the first right leg and a first left stop surface for contacting the first left leg, and wherein the second block comprises a second right stop surface for contacting the second right leg and a second left stop surface for contacting the second left leg.

17. The device of claim 16, wherein the first right stop surface is substantially perpendicular to and overhangs the first right surface and the first left stop surface is approximately perpendicular to and overhangs the first left surface, and wherein the second right stop surface is substantially perpendicular to and overhangs the second right surface and the second left stop surface is approximately perpendicular to and overhangs the second left surface.

18. The device of claim 11, wherein the first block is rotatably coupled to the horizontal beam via the first vertical fastener, and wherein the second block is rotatably coupled to the horizontal beam via the second vertical fastener.

19. The device of claim 18, wherein the first vertical fastener allows the first block to rotate around a vertical axis between a parallel position and a perpendicular position, and wherein the second vertical fastener allows the second block to rotate around a vertical axis between a parallel position and a perpendicular position.

* * * * *